US007737865B2

(12) United States Patent
Avidan

(10) Patent No.: US 7,737,865 B2
(45) Date of Patent: Jun. 15, 2010

(54) METHOD FOR DISPLAYING DYNAMICALLY DETERMINED PRIORITY LANES TO CUSTOMERS RETURNING VEHICLES TO A VEHICLE RENTAL COMPANY

(75) Inventor: Lawrence H. Avidan, 1001 Bridgeway # 995, Sausalito, CA (US) 94965

(73) Assignee: Lawrence H. Avidan, Sausalito, CA (US)

( * ) Notice: Subject to any disclaimer, the term of this patent is extended or adjusted under 35 U.S.C. 154(b) by 321 days.

(21) Appl. No.: 11/829,890

(22) Filed: Jul. 28, 2007

(65) Prior Publication Data

US 2009/0027230 A1 Jan. 29, 2009

(51) Int. Cl.
*G08G 1/14* (2006.01)

(52) U.S. Cl. ..... 340/932.2; 340/539.13; 340/572.1; 705/13

(58) Field of Classification Search ..... 340/932.2, 340/933, 572.1, 539.13; 705/13, 22, 28, 705/1, 417; 235/384–385
See application file for complete search history.

(56) References Cited

U.S. PATENT DOCUMENTS 3,665,397 A * 5/1972 Di Napoli et al. ..... 340/5.42
4,797,948 A * 1/1989 Milliorn et al. ..... 340/10.52
5,289,369 A * 2/1994 Hirshberg ..... 705/13
5,635,693 A * 6/1997 Benson et al. ..... 340/10.33
6,006,148 A * 12/1999 Strong ..... 701/33
6,873,840 B1 * 3/2005 von Alten ..... 455/410
6,898,493 B2 * 5/2005 Ehrman et al. ..... 701/35
2002/0184062 A1 * 12/2002 Diaz ..... 705/7
2002/0186144 A1 * 12/2002 Meunier ..... 340/825.28
2004/0249557 A1 * 12/2004 Harrington et al. ..... 701/115
2005/0038741 A1 * 2/2005 Bonalle et al. ..... 705/40

OTHER PUBLICATIONS

Computerworld Honors, http://www.cwhonors.org/search/his_4a_detail.asp?id=2555, Aug. 18, 2009.*

* cited by examiner

*Primary Examiner*—Brent Swarthout

(57) ABSTRACT

A method for displaying dynamically determined priority lanes for customers returning vehicles to a vehicle rental company. The method includes identifying a vehicle being returned by a customer to a vehicle rental company by an identification device and dynamically determining directions for the customer based on at least one of vehicle and customer specific parameters. The dynamically determined priority lanes are displayed to the customer in real time using a sign board, a display panel, etc.

2 Claims, 5 Drawing Sheets

METHOD FOR DISPLAYING DYNAMICALLY DETERMINED PRIORITY LANES TO CUSTOMERS RETURNING VEHICLES TO A VEHICLE RENTAL COMPANY

BACKGROUND OF THE INVENTION

1. Field of the Invention

The invention relates to the field of business practice and management for a vehicle renting company. More particularly, the invention is about better utilization of high-price and high-demand vehicles owned by the vehicle renting company.

2. Description of the Related Art

A vehicle rental company rents vehicles for short periods ranging from a few hours to a few weeks. It owns vehicle rental shops located near airports or busy city areas. The vehicle rental company primarily serves people who have a vehicle that is temporarily out of reach or out of service, for example, travelers who are out of town or owners of damaged or destroyed vehicle who are awaiting repair or insurance compensation.

The vehicle renting industry has grown rapidly in recent times. A recent survey conducted among the major players of this industry showed that in a year the reservation center of a typical vehicle rental company handles approximately 40 million requests and delivers approximately 30 million reservations. The rental companies own a large number and variety of vehicles.

One of the problems faced by the vehicle rental companies is that returning vehicles have to be taken to a servicing bay where the vehicles are cleaned, serviced, and repaired, if necessary. The process of cleaning, servicing, and repairing the vehicles can take a lot of time ranging from a few hours to a couple of days. None of the prior art disclosed herein teaches a method to conveniently and automatically distinguish between the high-priced, premium returning vehicles and the other returning vehicles. Similarly, none of the prior art disclosed herein teaches a method to conveniently and automatically distinguish between a premium customer and a normal customer.

U.S. Pat. No. 6,006,148 discloses an automated vehicle return system wherein status information of a rented vehicle is automatically tracked during the rental period and is transmitted to a selected destination computer upon driving the vehicle into a return area. Electronic vehicle monitoring circuitry is tied to existing components within the vehicle to keep track of the status of the vehicle during the rental period. The status information includes, miles driven, fuel level, pick up time, drop off time, wear and tear on the vehicle, etc. The status information is used by the destination computer to determine a bill for the rented vehicle.

U.S. Pat. No. 3,665,397 discloses an automatic automobile rental system having a plurality of remote rental stations and a central data processing station for system control and customer billing. A system user employs a credit card that is automatically read at a rental station to identify the user, and this information is checked at the central station to verify that the card holder is entitled to receive an automobile. The same card identifies the holder when the automobile is returned to the same or a different rental station. An ignition key and machine-readable car identification and mileage module are interconnected for reading and dispensing at a rental station and for use in operating an automobile. Mileage or other measure of usage of the rented automobile is recorded in an electrolytic cell as a state of charge proportional to mileage. The cell is transferred to the automobile for mileage recording and to the rental station for discharge and mileage reading.

Standard pulses of charge in a number proportional to mileage are used to charge the electrolytic cell. Data read from the electrolytic cell, from the user card, and from the automobile identification are transmitted to the central data processing unit over conventional telephone lines.

U.S. Pat. No. 4,797,948 discloses a communication system having a communication channel for transmitting data between a base station and a plurality of mobile radio units, wherein each radio unit has a unique identification (ID) code and wherein transmissions from each radio unit to the base station include the unit's ID code, a method is described for identifying which units are within RF communication proximity of the base station. The method includes: transmitting a range message, including a low ID code parameter and a high ID code parameter, from the base station over the channel to elicit a response from at least one of the mobile radio units having an ID code between the low and high parameters; determining whether radio units transmitted a message in response to the range message; and storing, responsive to transmission by the units, in an ID list a signal representative of the respective ID code assigned to such transmitting units. These steps are repeated with different transmitted range messages until each of the radio units within RF proximity of the base station is appended to the ID list.

U.S. Pat. No. 5,635,693 discloses a radio frequency (RF) tagging system to monitor vehicles passing through an area access to one or more vehicle storage area(s). One or more of the vehicles stored in the storage area is equipped with a RF tag, which has vehicle ID information about the vehicle stored in a tag memory contained on the tag. The tag communicates with a base station when passing through the area accesses, (entering or leaving). A central and preferably one or more remote computers accesses status information that might include vehicle identification, customer, lot identification, time of day, and vehicle and lot status. The information is used in security or marketing functions. The security function can include a paging system for sending alarms and/or messages to a manager or security personnel. The marketing function can include determining how long or how many times different makes an model of vehicle are chosen by customers for test drives. Additionally, the marketing function will identify past vehicles that were sold at the dealership as an indication of a potential interested buyer.

US Patent Publication No. 2002/0184062 discloses a vehicle management method and system to monitor and manage a fleet of vehicles with high efficiency and low cost. The management method includes the steps of providing a radio transmitter connected to a vehicle navigation system in each vehicle, providing a radio transmitter connected to a facility computer in a vehicle management facility, receiving information regarding use of a vehicle by the vehicle navigation system from the facility computer which is transmitted through the radio transmitters, monitoring usage of the vehicle and storing data thereof in a memory, and sending the stored data to the facility computer through the radio transmitters.

SUMMARY OF THE INVENTION

The disclosed invention has been conceived and developed to overcome the limitations of previous methods and processes used by vehicle renting companies.

An object of the present invention is to ensure minimum downtime and maximum availability of premium, high-priced, and high-demand vehicles by developing a method for instantaneous determination and display of the priority lane for each vehicle, to provide higher priority and expedited service to the premium, high-priced, and high-demand vehicles.

Another object of the present invention is to provide better and faster customer service to premium customers by developing a method for instantaneous and automatic identification of premium customers.

An embodiment of the invention describes a method for displaying dynamically determined priority return lanes to customers returning vehicles to a vehicle rental company. The method comprises a number of steps. The first step is to identify a returning vehicle by an identification device. The second step is to determine priority lanes for the customer dynamically based on vehicle or customer specific parameters. The third step is to display the dynamically determined directions to the customer in real time.

In another embodiment of the invention, the identification device is a radio frequency identification (RFID) scanner scanning a radio frequency identification (RFID) tag positioned in or on the vehicle.

In another embodiment of the invention, the identification device is a license plate scanner.

In another embodiment of the invention, the identification device is a bar code scanner scanning a bar code identification tag positioned in or on the vehicle.

In yet another embodiment of the invention, the vehicle specific parameters include the demand for the vehicle, the price of the vehicle, and/or the make and model of the vehicle.

In yet another embodiment of the invention, the customer specific parameters may include the relative importance of the customer to the vehicle rental company.

In yet another embodiment of the invention, the dynamically determined priority return lanes may be displayed to the customer on a display panel. The lane having high priority is serviced faster and the return lane having low priority is serviced slower. Another embodiment of the invention describes a system for displaying dynamically determined priority return lanes for customers returning vehicles to a vehicle rental company. The system comprises a database system for storing vehicle and customer specific parameters, an identification device for identifying the returning vehicles, a module for determining the priority return lane of each returning vehicle and displaying the priority return lane to the customer in real time.

BRIEF DESCRIPTION OF PREFERRED EMBODIMENTS

Preferred embodiments are illustrated by way of example, and not by way of limitation, in the accompanying drawings and in which identical reference numerals in different figures refer to same elements.

DETAILED DESCRIPTION OF PREFERRED EMBODIMENTS

In the following description of various embodiments including the preferred embodiment, reference is made to the accompanying drawings, which show by way of illustration the embodiments in which the invention may be practiced. It is to be understood that other embodiments may be used and structural and functional modifications may be made without departing from the spirit or scope of the invention. Those skilled in the art will readily appreciate that the detailed description given herein with respect to these drawings is for explanatory purposes as the invention extends beyond these limited embodiments.

Figure 1A:
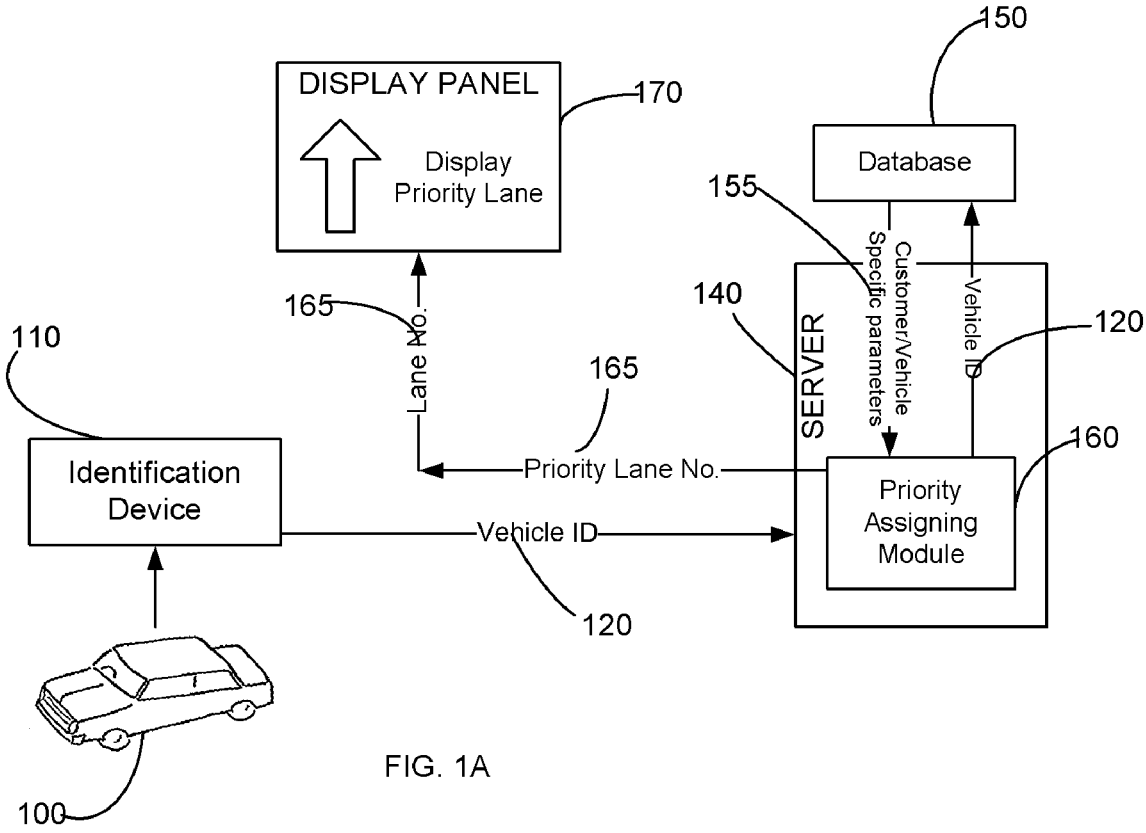
FIG. 1A and FIG. 1B show overview of embodiments of an invention for displaying dynamically determined directions for customers returning vehicles to a vehicle rental company.

FIG. 1A shows an overview of an embodiment of the invention as disclosed herein. The embodiment discloses a method for displaying dynamically determined directions for customers returning vehicles to a vehicle rental company. The embodiment includes an identification device 110 used for identifying a vehicle ID 120 of a returning vehicle 100. Examples of the identification device 110 can be a barcode scanner, a radio frequency scanner, a license plate scanner, any other device used for identification of returning vehicles, etc. The identification device 110 can be connected through a wired or wireless communication medium to a server 140. The server 140 can include a priority-assigning module 160. The priority-assigning module 160 may be connected to a database 150 and a display panel 170. Examples of display panel 170 can be a signboard, a liquid crystal display, a plasma display panel, etc.

The identification device 110 identifies the vehicle ID 120 of the returning vehicle 100, for example, by scanning a vehicle identification tag placed inside or on the vehicle. The vehicle ID 120 retrieved by the identification device 110 can be transmitted to the priority-assigning module 160 residing on the server 140. The priority-assigning module 160 can be a tailored software module programmed to determine a priority return lane 165 based on vehicle specific and customer specific parameters 155. After receiving the vehicle ID 120, the priority-assigning module 160 queries the database 150 to retrieve customer specific and vehicle specific parameters 155. The database 150 may be kept updated dynamically at all times with the latest values of customer specific parameters and vehicle specific parameters. Examples of customer specific parameters can be "Premium User," "Normal User," "Pending Requests," etc. Similarly, examples of vehicle specific parameters can be "Name of the vehicle", "Model of the vehicle", "Price of the vehicle", "Availability of the vehicle", "Mileage of the vehicle", "Demand of the vehicle", "Pending requests", etc. The priority-assigning module 160, based on the customer specific 155 and vehicle specific parameters 155 stored in the database 150, determines the priority return lane 165 for the returning vehicle 100 and sends a message containing the priority return lane 165 to the display panel 170. The returning vehicle can be driven to the priority return lane 165 displayed on the display panel 170.

Figure 1B:
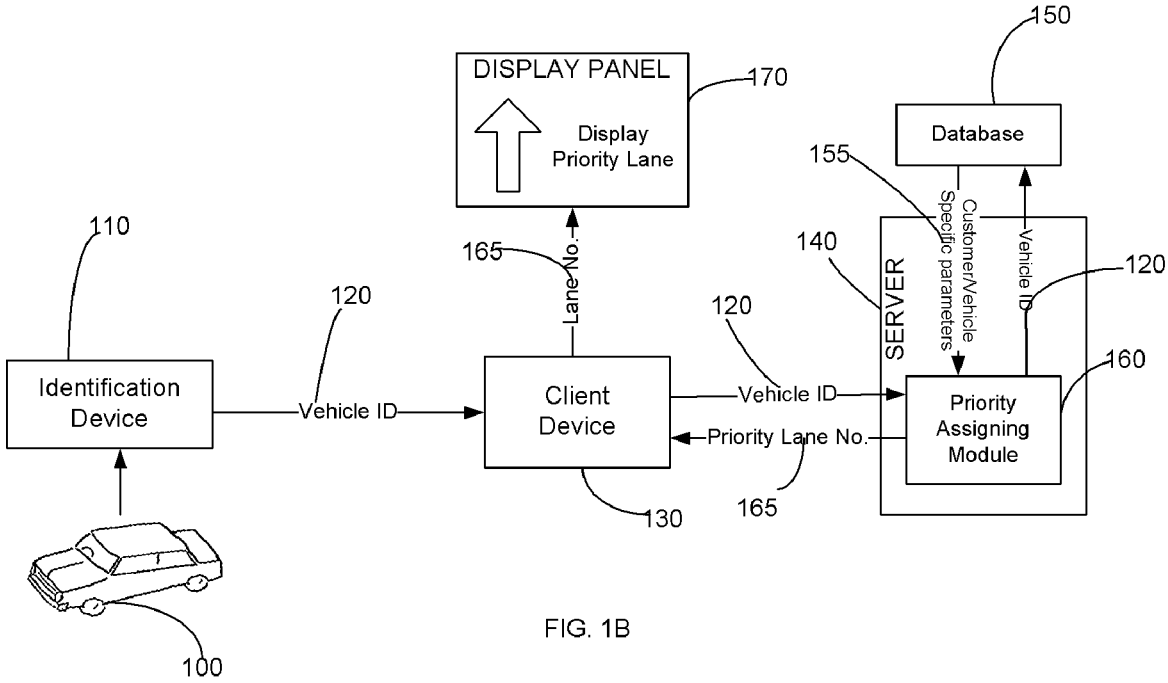

The embodiment shown in FIG. 1B is similar to the embodiment shown in FIG. 1A. The only difference between FIG. 1A and FIG. 1B is that in the embodiment shown in FIG. 1B, the identification device 100 is not connected directly to the priority-assigning module 160 residing on the server 140. Instead, there is a client device 130 placed intermediate between the identification device 100 and the priority-assigning module 160. Examples of the client device 130 are a PC, a desktop, a laptop, a PDA, etc. The client device 130 is also placed intermediate between the priority-assigning module 160 and the display panel 170. The client device 130 can be connected to the server 140 and the display panel 170 through a wired or wireless communication medium.

Figure 2:
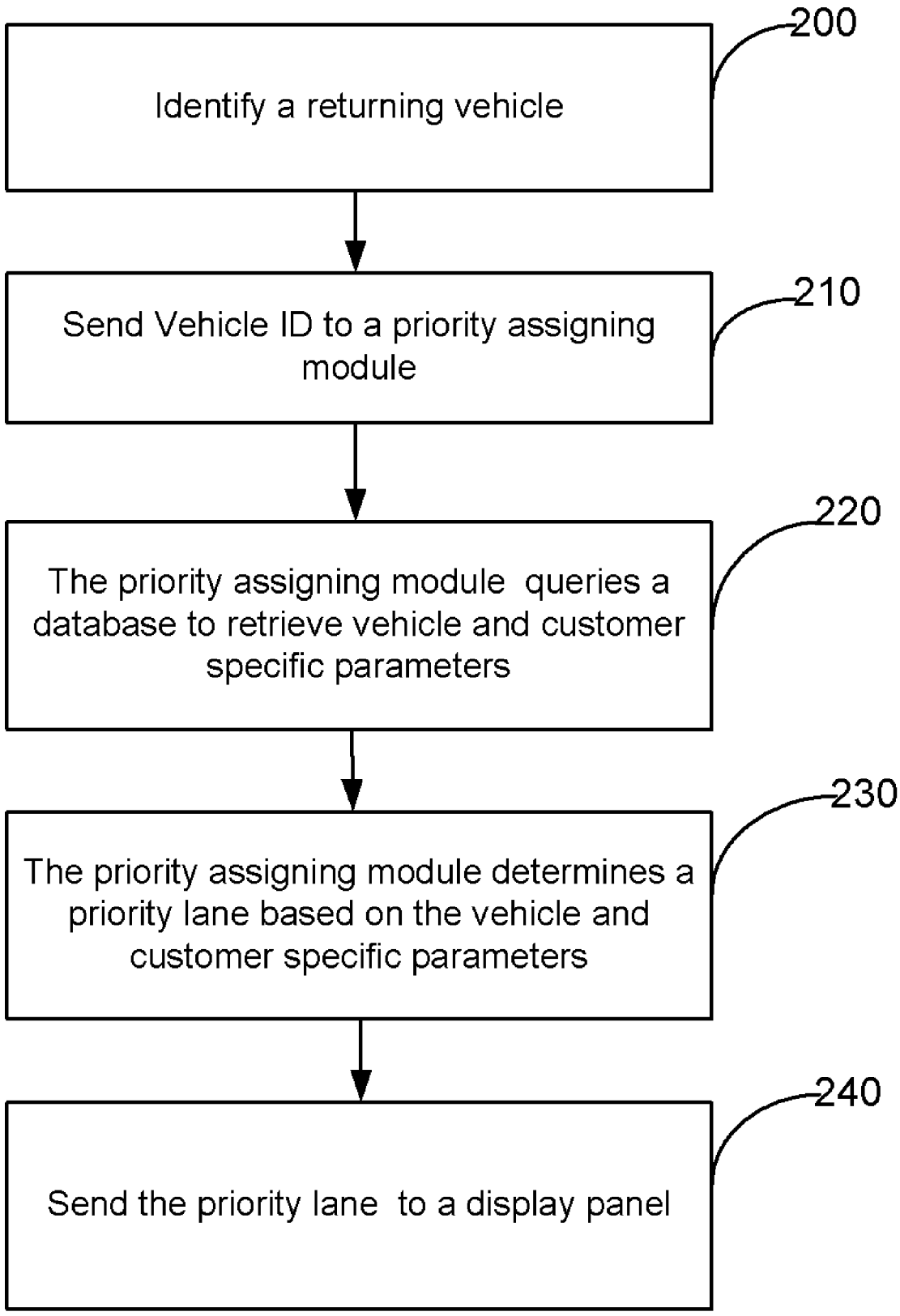
FIG. 2 shows a flow diagram illustrating a process for displaying dynamically determined directions for customers returning vehicles to a vehicle rental company.

FIG. 2 shows a flow diagram illustrating the process for displaying dynamically determined directions for customers returning vehicles to a vehicle rental company.

In step 200, an identification device identifies a returning vehicle using a vehicle ID tag attached to a vehicle returned by a customer to a vehicle rental company. The identification device transmits the vehicle ID retrieved from the vehicle ID tag, to a client device using a wired or wireless communication medium.

In step 210, the client device passes the vehicle ID to a priority-assigning module residing on a server.

In step 220, after receiving the vehicle ID, the priority-assigning module residing on the server queries a database to retrieve vehicle specific and customer specific parameters.

In step 230, the priority-assigning module, which can be a tailored software module, determines a priority lane for a returning vehicle based on the vehicle specific and customer specific parameters.

In step 240, the priority-assigning module sends a message to a display panel. The display panel displays the priority lane to the driver of the returning vehicle.

Figure 3:
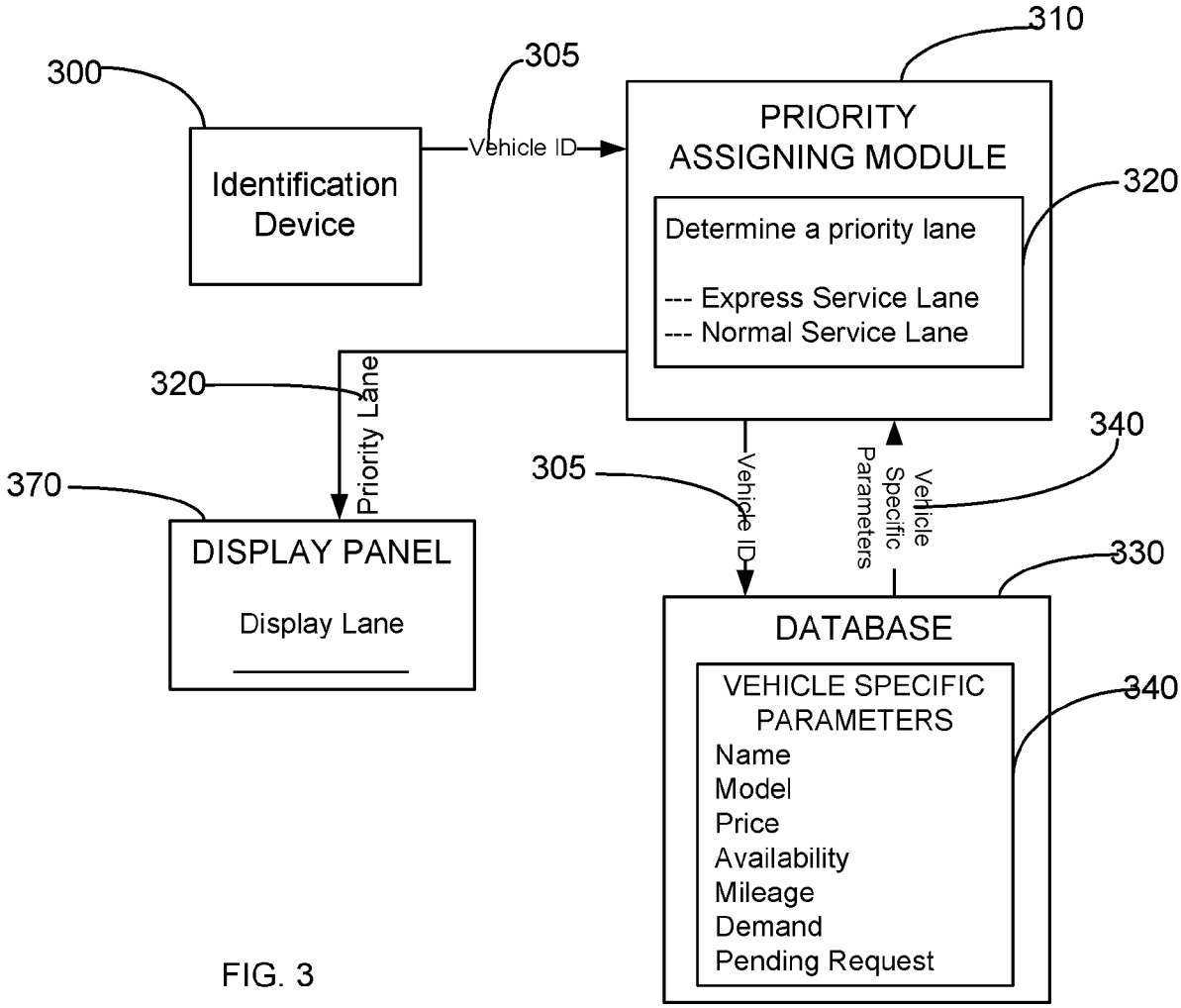
FIG. 3 illustrates a process for assigning a priority status and a return lane to returning vehicles based on vehicle specific parameters in an embodiment of a method for displaying dynamically determined directions for customers returning vehicles to a vehicle rental company.

FIG. 3 illustrates an embodiment of the process of assigning priority to a returning vehicle 100 (shown in FIG. 1) using a priority-assigning module 310 in a method for displaying dynamically determined directions for customers returning vehicles to a vehicle rental company.

An identification device 300 identifies a vehicle ID 305 of the returning vehicle 100 (shown in FIG. 1) and sends it to a priority assigning module 310. The priority-assigning module 310, after receiving the vehicle ID 305 queries a database 330 to retrieve vehicle specific parameters 340. The database 330 may be kept updated at all times with the latest values of customer specific parameters and vehicle specific parameters. Examples of vehicle specific parameters 340 can be "Name of the vehicle", "Model of the vehicle", "Price of the vehicle", "Availability of the vehicle", "Mileage of the vehicle", "Demand of the vehicle," "Pending Requests", etc. The demand of the vehicle may vary due to many reasons, for example, seasonality. For example, a four-wheeled-drive vehicle may be having large demand during the skiing season, but may have only low demand during the non-skiing season. The priority-assigning module 310 can be a tailored software module programmed to determine a priority lane 320 based on the vehicle specific parameters. In another embodiment, the priority lane 320 can be determined based on customer specific parameters. Examples of the priority lanes 320 can be, but not limited to, "Express Service Lane" and "Normal Service Lane".

For example, if the priority of the returning vehicle 100 (shown in FIG. 1) is high, the returning vehicle 100 (shown in FIG. 1) may be allotted an "Express Service Lane". In the "Express Service Lane," the vehicle may be provided expedited service, thus minimizing downtime and maximizing availability for high priority vehicles. Similarly, if the priority of the returning vehicle 100 (shown in FIG. 1) is medium or low, the returning vehicle 100 (shown in FIG. 1) may be allotted a "Normal Service Lane".

After determination of priority, a message with the priority lane 320 for the returning vehicle 100 (shown in FIG. 1) can be sent to a display panel 370. The display panel 370 displays the priority lane 320 to the driver of returning vehicle. The returning vehicle can be driven to the priority lane 320 displayed on the display panel 370.

Figure 4:
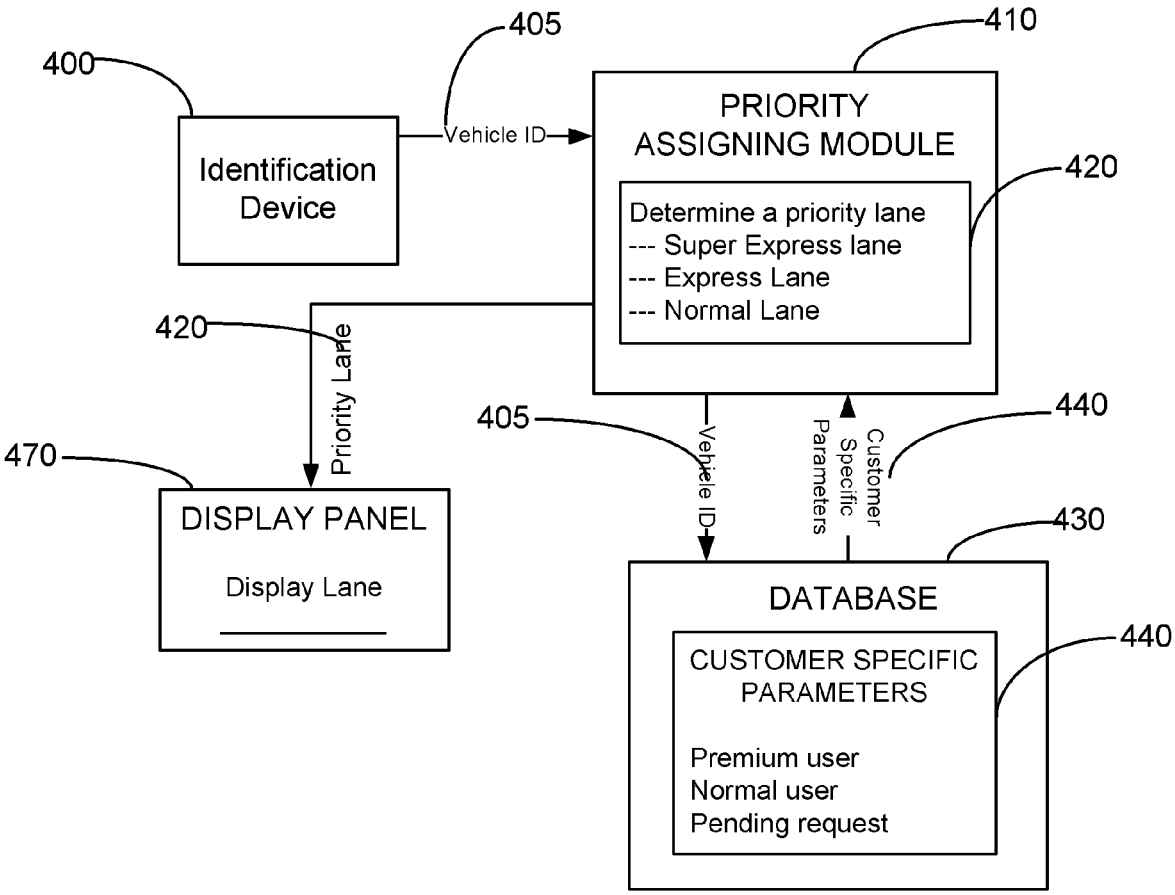
FIG. 4 illustrates a process for assigning a priority status and a return lane to returning vehicles using customer specific parameters in an embodiment of a method for displaying dynamically determined directions for customers returning vehicles to a vehicle rental company.

FIG. 4 illustrates an embodiment of the process of assigning priority to returning vehicles 100 (shown in FIG. 1) using customer specific parameters in a method for displaying dynamically determined directions for customers returning vehicles to a vehicle rental company.

An identification device 400 identifies a vehicle ID 405 of a returning vehicle 100 (shown in FIG. 1) and sends it to a priority-assigning module 410. The priority assigning module 410, after receiving the vehicle ID 405 queries a database 430 to retrieve customer specific parameters 440. Examples of customer specific parameters 440 can be "Premium User," "Normal User," "Pending Requests," etc. The priority-assigning module 410 can be a tailored software module programmed to determine a priority lane 420 based on the customer specific parameters 440. The priority lane 420 may be, but not limited to, "Super Express Lane", "Express Lane", and "Normal Lane".

For example, if the priority of the returning vehicle 100 (shown in FIG. 1) is high based on the customer specific parameters, the returning vehicle 100 (shown in FIG. 1) may be allotted "Super Express Lane". The advantage of "Super Express Lane" is that the customer has to spend minimum time in completing the returning formalities and the attendants provide premium service. Similarly, if the priority of the returning vehicle 100 (shown in FIG. 1) is medium, the returning vehicle 100 (shown in FIG. 1) may be allotted "Express Lane". Similarly, if the priority of the returning vehicle 100 (shown in FIG. 1) is low, the returning vehicle 100 (shown in FIG. 1) may be allotted "Normal Lane".

After determination of priority, a message with the priority lane 420 for the returning vehicle 100 (shown in FIG. 1) can be sent to a display panel 470. The display panel 470 displays the priority lane 420 to the driver of returning vehicle. The returning vehicle can be driven to the priority lane 420 displayed on the display panel 470.

Having fully described the preferred embodiments, other equivalent or alternative methods for displaying dynamically determined directions for customers returning vehicles to a vehicle rental company will be apparent to those skilled in the art. The invention has been described above by way of illustration, and the specific embodiment disclosed is not intended to limit the invention to the particular forms disclosed. For example, the embodiments described in the foregoing were directed to providing a clear idea about the preferred modes, including the best mode, of making and using the present invention. However, in alternate embodiments, those skilled in the art may implement the invention without deviating from the central idea of the invention. The invention therefore covers all modifications, equivalents, and alternatives falling within the spirit and scope of the following claims.

I claim:

1. A method for displaying dynamically determined priority return lanes to customers returning vehicles to a vehicle rental company, the method comprising:

identifying a vehicle being returned by a customer to a vehicle rental company by an identification device wherein, said identification device includes a bar code scanner or a license plate scanner;

determining priority return lanes dynamically for the customer based on demand for the vehicle, the price of the vehicle, and the make and model of the vehicle; and displaying the dynamically determined priority lanes to the customer in real time.

2. System for displaying dynamically determined priority lanes for customers returning vehicles to a vehicle rental company, the system comprising:

a database system for storing vehicle and customer specific parameters for vehicles and customers of a vehicle rental company;

an identification device for identifying a vehicle being returned by a customer of the vehicle rental company;

a module for determining the priority status of each returning vehicle and determining a priority return lane based on the demand for the vehicle, the price of the vehicle, and the make and model of the vehicle; and means for displaying the dynamically determined priority return lanes to the customer in real time wherein the means includes a display panel.

* * * * *